US006760943B2

(12) United States Patent
Williams

(10) Patent No.: US 6,760,943 B2
(45) Date of Patent: Jul. 13, 2004

(54) DEVICE FOR HOLDING ARTICLES DURING WASHING

(76) Inventor: Glenn D. Williams, 2020 Swansen Rd., Baltimore, MD (US) 21239

( * ) Notice: Subject to any disclaimer, the term of this patent is extended or adjusted under 35 U.S.C. 154(b) by 307 days.

(21) Appl. No.: 10/108,523

(22) Filed: Mar. 27, 2002

(65) Prior Publication Data

US 2002/0108186 A1 Aug. 15, 2002

Related U.S. Application Data

(63) Continuation-in-part of application No. 09/542,957, filed on Jul. 24, 2000.

(51) Int. Cl.[7] ..... D06F 35/00

(52) U.S. Cl. ..... 8/159; 68/13 R; 68/213; 68/235 R

(58) Field of Search ..... 8/158, 159; 68/13 R, 68/213, 235 R

(56) References Cited

U.S. PATENT DOCUMENTS

| | | | | |
|---|---|---|---|---|
| 2,015,119 A | * | 9/1935 | McEwen | 383/40 |
| 2,133,584 A | * | 10/1938 | Spanel | 8/137 |
| 2,285,547 A | * | 6/1942 | Milton | 210/237 |
| 2,656,394 A | * | 10/1953 | Griffin et al. | 568/575 |
| 2,697,465 A | * | 12/1954 | Johnson | 383/4 |
| 3,036,616 A | | 5/1962 | Allen | 150/1 |
| 3,376,718 A | * | 4/1968 | Kahn | 68/4 |
| 5,253,775 A | * | 10/1993 | Gould | 220/23.83 |
| 5,503,476 A | | 4/1996 | Hamdan | 383/9 |
| 5,803,605 A | | 9/1998 | Masi | 383/38 |

FOREIGN PATENT DOCUMENTS

| | | | |
|---|---|---|---|
| JP | 2000-167287 | * | 6/2000 |

* cited by examiner

*Primary Examiner*—Frankie L. Stinson
(74) *Attorney, Agent, or Firm*—Armstrong, Kratz, Quintos, Hanson & Brooks, LLP

(57) ABSTRACT

A device having a flexible member with a plurality of pouches. A pair of matched articles are placed in each of the separate pouches. The flexible member is mounted on an agitator in a washing machine and the pairs of articles are washed together with the flexible member. The flexible member containing the pairs of articles are dried. A method of use is disclosed.

18 Claims, 6 Drawing Sheets

DEVICE FOR HOLDING ARTICLES DURING WASHING

CROSS REFERENCE TO RELATED APPLICATION

The present application is a continuation-in-part of application Ser. No. 09/542,957, filed Jul. 24, 2000, the disclosure of which is incorporated in its entirety by reference herein.

BACKGROUND OF THE INVENTION

1. Field of the Invention

The present invention is related to a device for holding and separating articles during washing and drying and more particularly to a flexible member having a plurality of pouches in which the articles are disposed during washing and drying.

2. Description of Related Art

A problem frequently encountered in every household is the separation of laundry and the need to match socks, and other paired items of clothing. Much time and energy are required to sort the laundry to find a sock of the size, color and pattern which matches a similar sock. This problem is magnified when the laundry include clothing from several adults and several children.

The applicant is aware of devices to hold laundry.

Allen in U.S. Pat. No. 3,036,616 discloses an integrated article washing unit for washing a variety of articles of clothing in a single operation. It comprises a series of individual containers each of which serving to hold at least one article of clothing for washing including hosiery.

Gould in U.S. Pat. No. 5,253,775 discloses a combined hamper and laundry bag which are used for separating large and small articles, most particularly socks. The bag is placed into the washer and dryer.

Hamdan in U.S. Pat. No. 5,503,476 discloses a pre-sort and organization laundry apparatus including a laundry bag. The bag has a plurality of pockets on the outside surface for holding objects of various sizes including socks. The bag also has a hanging means and a closure means.

Masi in U.S. Pat. No. 5,803,605 discloses a compartmented laundry bag for washing and drying small articles such as socks. The bag consists of a main pocket and multiple small, individual pockets which are located on each side of the main pocket. A number of embodiments are disclosed.

While these devices may be useful, they serve either limited purposes and a more versatile, utilitarian device is needed.

SUMMARY OF THE INVENTION

It is an object of the present invention to have a device which can be easily mounted on the agitator of a washing machine and can contain a plurality of articles to be washed.

It is a further object of the present invention to have a device to hold a plurality of pairs of articles to be washed, wherein each pair is separated from the other pairs.

It is another object of the present invention to have a device which may be disposed in a clothes drier after the washing has been completed.

It is still another object of the present invention to provide a means to sort pairs of articles to be washed and to avoid the sorting and matching the articles after washing.

In accordance with the teachings of the present invention, there is disclosed the combination of a washing machine having a rotating or oscillating agitator and a sock saver device, the sock saver device is a substantially flexible member having a first means thereon to mount the sock saver device onto the agitator for rotation or oscillation in unison. A second means is formed externally on the sock saver device for carrying respective pairs of socks thereon and for maintaining the respective pairs of socks together during operation of the washing machine. In this manner, the respective pairs of socks are always matched and are not separated or lost.

In further accordance with the teachings of the present invention, there is disclosed a method for keeping pairs of articles separated during washing in a washing machine. A flexible member is provided having a plurality of pouches formed externally thereon. The flexible member has means thereon to mount the flexible member on an agitator in the washing machine for rotation or oscillation in unison with the agitator. A plurality of pairs of articles to be washed are matched. Each pair of articles is inserted in a separate pouch in the flexible member. The flexible member is mounted on the agitator. The flexible member containing the plurality of pairs of articles is washed in the washing machine. The flexible member is dismounted from the agitator. The flexible member and the plurality of pairs of articles contained in the pouches is dried. Each pouch is opened and the clean pair of matched articles are removed from each pouch. In this manner, the pairs of matched articles are washed and dried and separated from all other pairs of articles.

In still further accordance with the teachings of the present invention, there is disclosed a laundry container for holding matched articles of clothing during washing and drying. The laundry container has a substantially flexible member having a mounting means thereon. A plurality of pouches are carried on the flexible member in which the matched articles of clothing are contained during the washing and drying. The matched articles of clothing are always matched and are not separated or lost.

These and other objects of the present invention will become apparent from a reading of the following specification taken in conjunction with the enclosed drawings.

DESCRIPTION OF THE PREFERRED EMBODIMENTS

Figure 1:
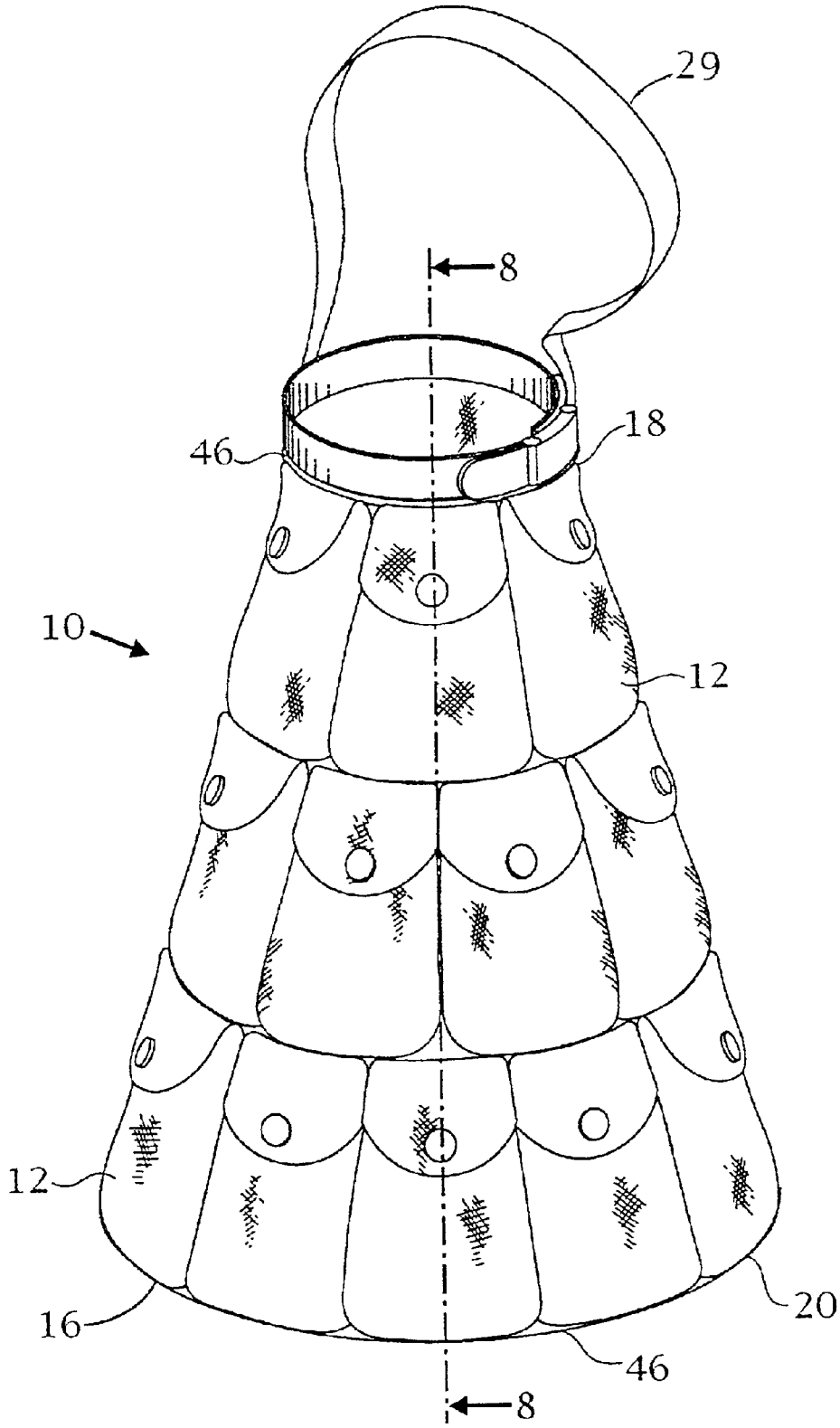
FIG. 1 is a perspective view of the flexible member showing the pouches thereon.
Figure 2:
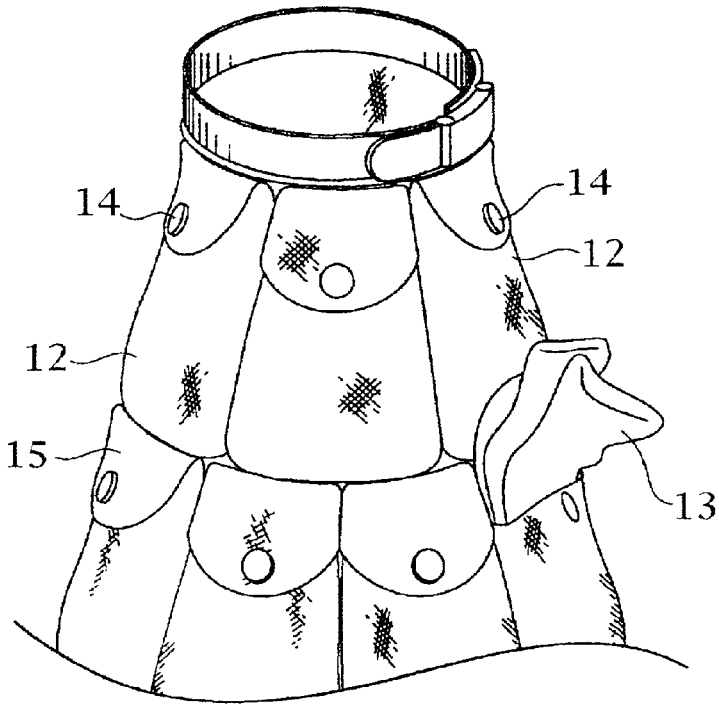
FIG. 2 is an enlarged view showing one of the pouches opened for insertion of a pair of socks.
Figure 3:
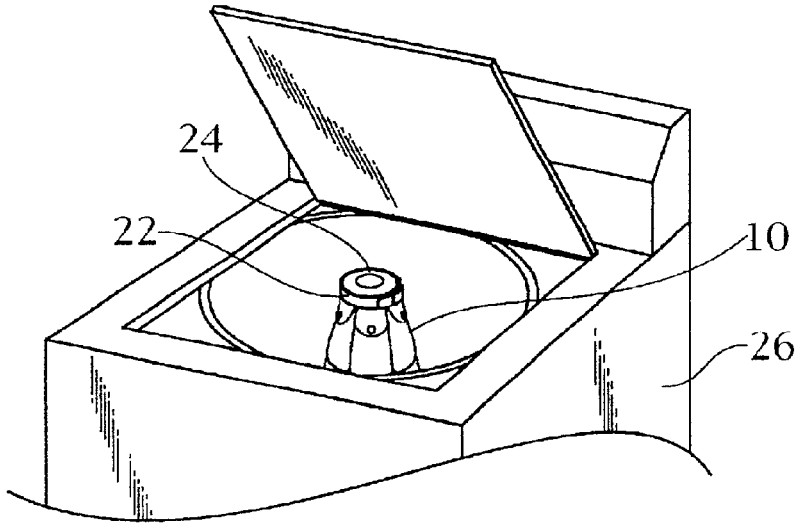
FIG. 3 is a perspective view of the flexible member mounted on the agitator of the washing machine.

Referring now to FIGS. 1 and 2, a flexible member 10 is formed from a porous fabric through which water flows freely. The fabric may be synthetic such as nylon, acetate or polyester or may be natural fibers such as cotton. The synthetic material is preferred because of its more rapid drying when wet. The weave of the fabric is, preferably, an open weave or mesh to facilitate drying and the passage of water. Other fabrics and fibers known to persons skilled in the art may be used, the fabrics and fibers are not limited to those suggested herein.

Externally on the flexible member 10 there are formed a plurality of pouches 12 which are disposed circumferentially and radially about the flexible member. A closing means 14 is formed on each pouch 12 to retain articles 13 within the individual pouches 12, as will be explained. The closure means 14 may be snaps, buttons, zippers, hook and loop fasteners, or other closure means known to persons skilled in the art. The pouch 12 may have a closure flap 15.

The flexible member 10 is sleeve-like, having a through opening 16 between a top end 18 and a bottom end 20. Preferably, the cross-sectional area of the top end 18 is less than the cross-sectional area of the bottom end 20. Means 20 for mounting the flexible member 10 on an agitator 24 of a washing machine 26 are attached to the flexible member 10 (FIGS. 3–7). Preferably, the means 20 are attached to the top 18 of the flexible member, but may be at the bottom end 20 or intermediately therebetween. The means 20 provide an adjustment to the cross-sectional area of the flexible member. The means 20 may be a drawstring, hook and loop fastener or elastic band but preferably is a more positive means to assure the mounting when the agitator rotates or oscillates. It is preferred that the flexible member 10 with the articles 13 in the pouches 12 rotate or oscillate in unison with the agitator 24 and a secure mounting is highly desirable.

Figure 4:
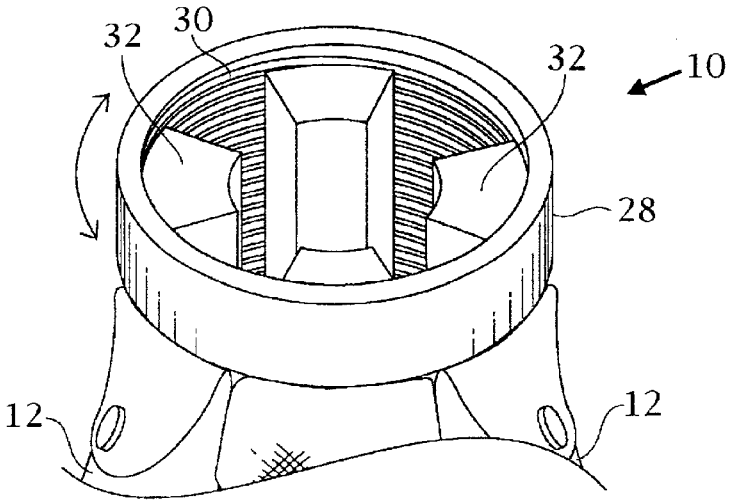
FIG. 4 is a perspective view of a threaded means to mount the flexible member on the agitator.
Figure 5:
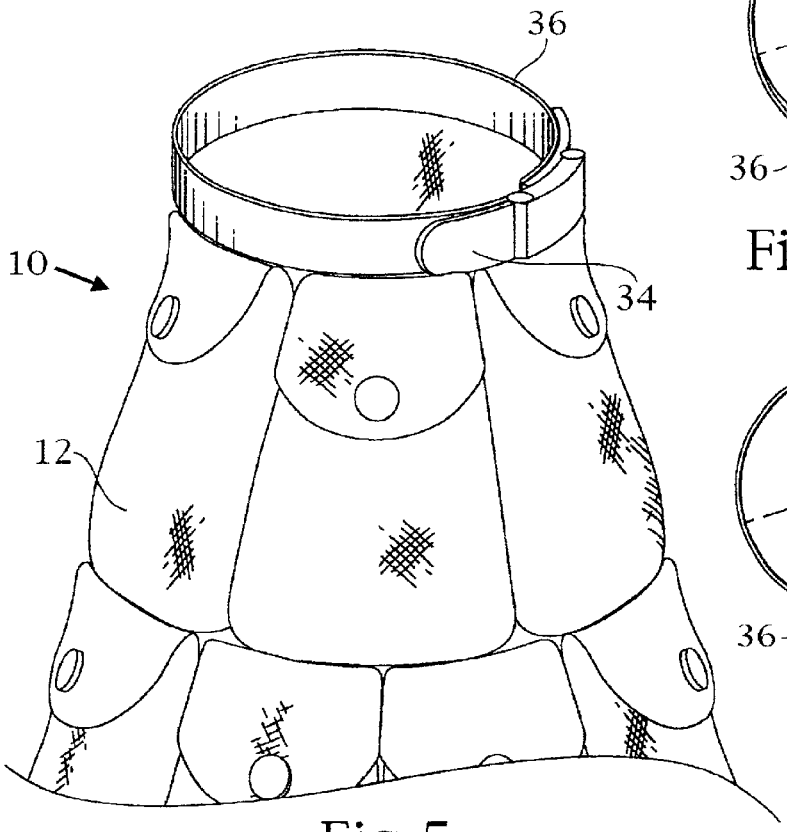
FIG. 5 is a perspective view of a clamping means to mount the flexible member on the agitator.
Figure 6:
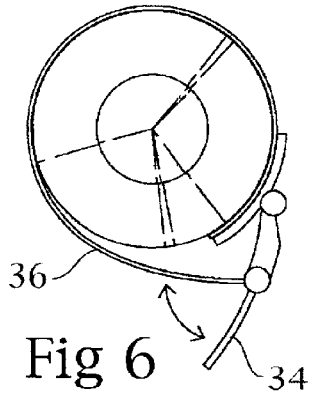
FIG. 6 is a top view of the mounting means in an open position.
Figure 7:
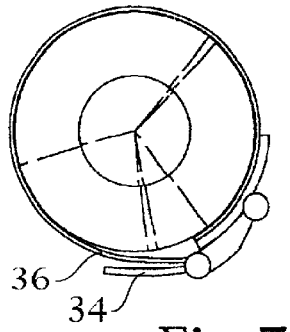
FIG. 7 is a top view of the mounting means in a closed position.

A threaded mounting means 20 may be a rotatable collar 28 having a threaded inner surface 30 (FIG. 4). A plurality of chucks 32 are disposed within the collar 28 and the chucks 32 cooperate with the threaded inner surface 30 such that rotating the collar 28 in a first direction causes the chucks 32 to move toward one another thereby reducing the cross-sectional area of the opening and securing the flexible member 10 to the agitator 24. Moving the collar 28 in a second opposite direction moves the chucks 32 away from one another, thereby enlarging the cross-sectional area of the opening and releasing the flexible member from the agitator 24. Other threaded means may be one or more threaded screws engaged in a corresponding number of cooperatively threaded openings in the top end of the flexible member. The one or more screws are moved inwardly to engage the agitator 24 or moved outwardly to disengage the agitator 34. Other threaded means known to persons skilled in the art maybe used. An alternate embodiment for mounting the flexible member 14 to the agitator 24 is a clamping means. Many clamping means known to persons skilled in the art may be used. The clamping means shown in FIGS. 5–7 is for purposes of illustration only and is not intended to be limiting. A pivoted handle 34 is connected to a spring-like band 36 which is attached to the flexible member 10. Pivoting the handle 34 toward the band 36 tightens the band 36 around the agitator 24 and pivoting the handle 34 outwardly from the band 36 loosens the band 36 from around the agitator 34.

Figure 8:
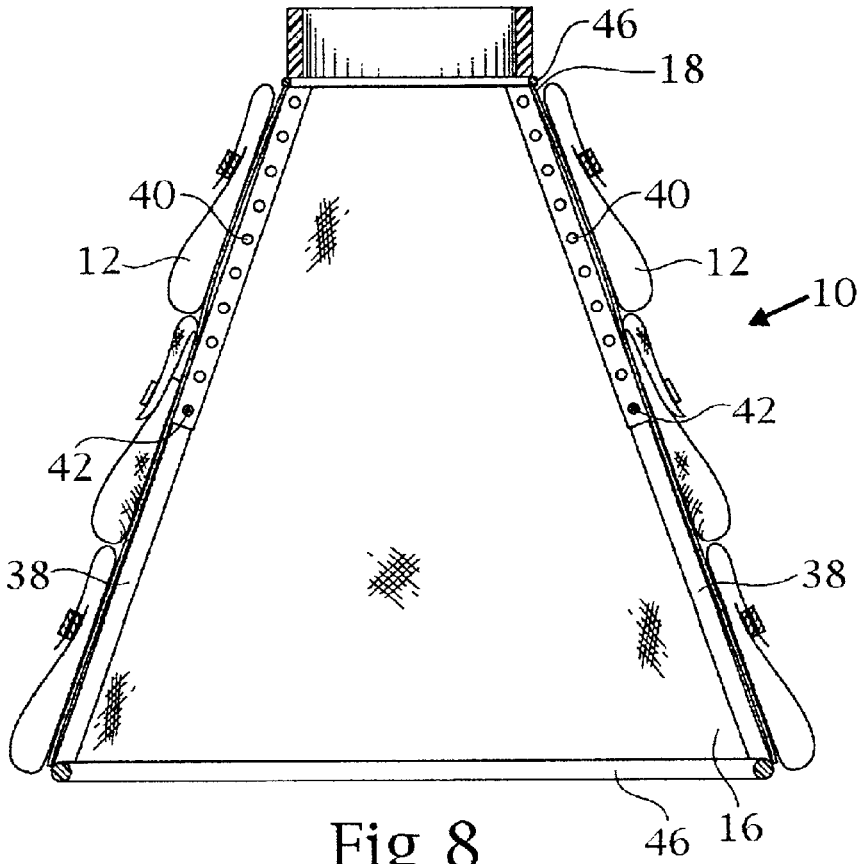
FIG. 8 is a cross-section view taken along the lines 8—8- of FIG. 1.
Figure 9:
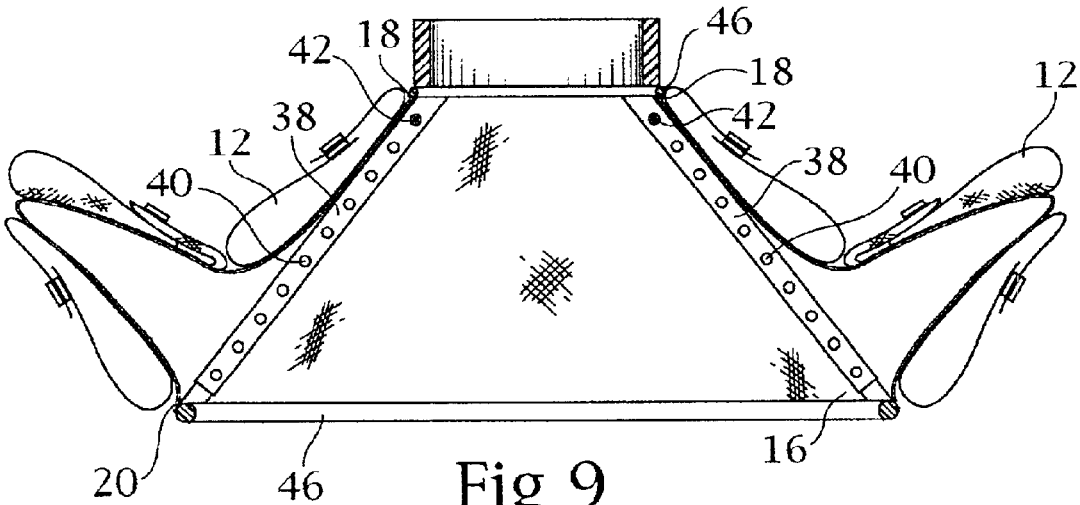
FIG. 9 is a view of the device of FIG. 6 in a collapsed position.

The flexible member 10 may further have at least two collapsible side supports 38 attached thereto (FIGS. 8–9). Preferably there are three side supports 38. The side supports 38 may be fully or partially collapsible. One embodiment of a collapsible side support has two telescoping portions with a plurality of openings 40 in one portion and a detent 42 in the other portion. The disposition of the detent in a selected one of the openings 40 determines whether the flexible member 10 is fully or partially collapsed. The side supports 38 may be attached directly to the flexible member 10 or may be indirectly attached by means of braces 46 at opposite ends 18, 20 of the flexible member 10. The braces 46 may be rigid or semi-rigid members attached to the flexible member or may be reinforced fabric. The collapsible side supports 38 may have structures not disclosed herein but known to persons skilled in the art. The reduced height of the flexible ember 10 resulting from partial or complete collapse is preferred to more easily dispose the flexible member containing the articles into a clothes drier 44 after washing. The opening to put material in the clothes drier varies depending on the manufacturer and the model of the clothes drier and there is no minimum standardized opening. Thus, the collapsibility feature of the present invention is highly desirable to provide a device which is conveniently usable.

It is preferred that the flexible member 10 have an overall height of approximately fourteen inches to conform to the depth of most washing machines. However, the device of the present invention may be used in smaller washing machines by adjusting the side supports 38 to accommodate the size of the washing machine. The side supports 38 can be shortened to approximately seven inches and adjusted to lengths between seven and fourteen inches.

The bottom end 20 of the flexible member 10 preferably has a diameter of approximately ten inches to completely encircle the agitator 24 in most washing machines 26. The top end 18 of the flexible member is approximately six inches in diameter to receive therein the agitator 24 of most washing machines 26. The mounting means 22 on the top end 18 is adjustable to reduce the opening from approximately 4½ inches to approximately 2½ inches. The range of opening encompasses the agitators of most commercially available washing machines to enable the present invention to be more universally used. A carrier strap 29 may be attached to assist in carrying the device.

The device of the present invention may be identified as a sock saver.

The method of using the present invention is to select matched pairs of socks or other articles 13 from laundry to be washed. It should be noted that the present invention may be used for socks of any size, color or material of fabrication, other articles which are in pairs or even non-paired articles which are delicate or subject to possible damage in a washing machine. This could include hose or lingerie.

Each article or pair of matched articles is inserted into a separate pouch 12 and each pouch 12 is secured with the closure means 14. Thus, each matched pair is isolated from every other matched pair and also from any other articles which may be washed in the washing machine 26 at the same time. The flexible member 10 is attached to the agitator in the washing machine 26 by the mounting means 22. Preferably, the agitator 24 is received within the through opening 16 in the flexible member 10 such that the bottom end 20 of the flexible member 10 is disposed circumferentially about the agitator 24. Other laundry to be washed is introduced into the washing machine.

The laundry, including the flexible member 10 with the contents of the pouches 12, are all washed through a selected complete cycle of the washing machine. The mounting means 22 is opened and the flexible member 10 with the contents of the pouches 12 is dismounted from the agitator 24 and removed from the washing machine 26.

Figure 10:
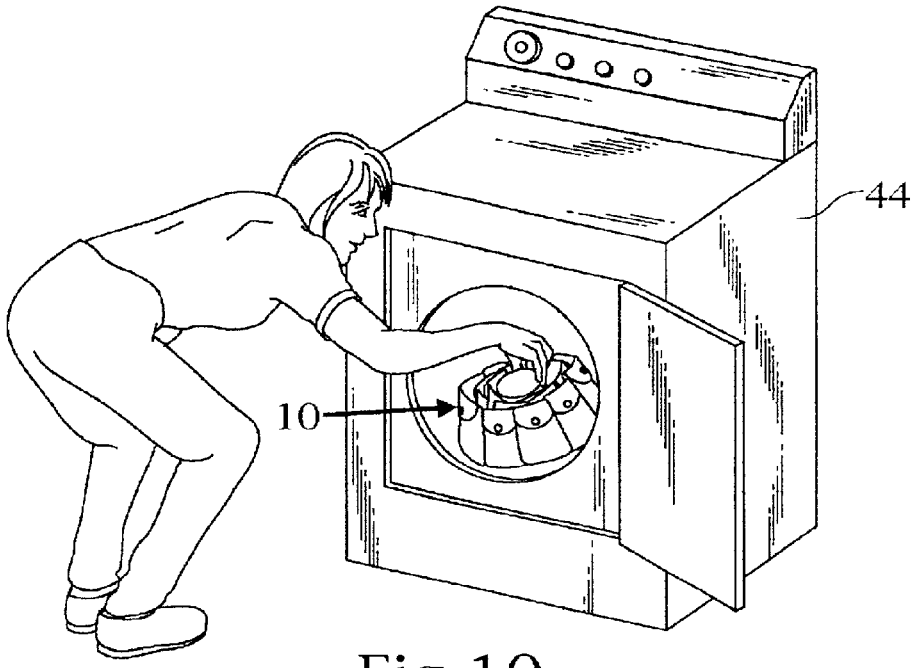
FIG. 10 is a perspective view showing the partially collapsed flexible member being disposed in a clothes drier.

The flexible member 14 including the contents of the pouches 12 is dried. In the event that a clothes drier 44 is used for drying, the height of the flexible member 10 is compared with the size of the opening into which articles are introduced into the clothes drier 44. If the flexible member 10 is too high, the side supports 38 are shortened to permit the flexible member 10 to be placed inside the clothes drier 44. This may require complete or only partial collapsing of the side supports 38. The flexible member 10 including the contents of the pouches either in the collapsed or uncollapsed position, is placed inside (FIG. 10). Also placed in the clothes drier 44 are other laundry which is separate from the flexible member 10 including the contents of the pouches 12. The clothes drier 44 is operated through a drying cycle. The dried flexible member 10 including the contents of the pouches 12 are removed from the clothes drier 44.

Figure 11:
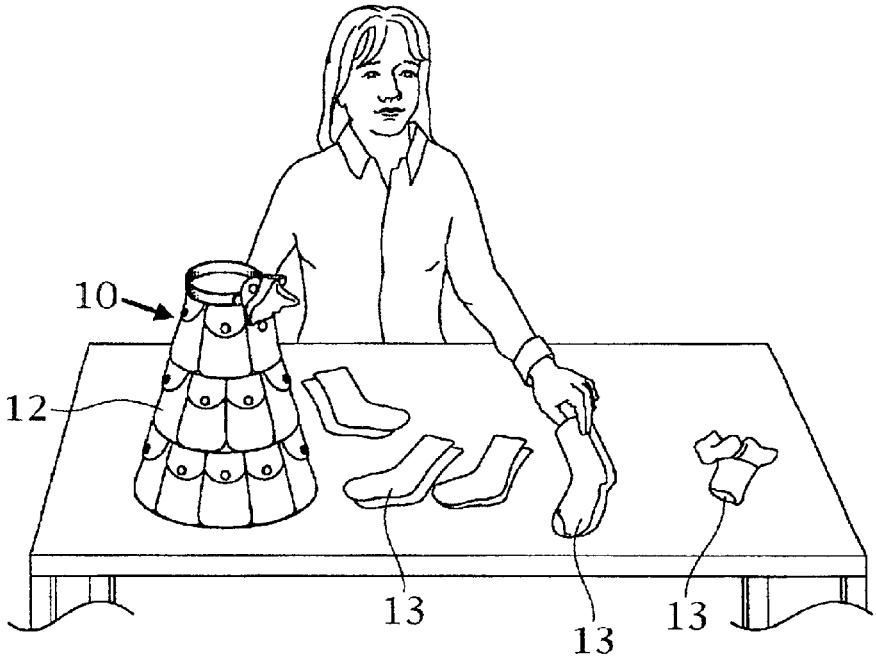
FIG. 11 is a perspective view showing the pairs of dry articles being removed from the flexible member.
Figure 12:
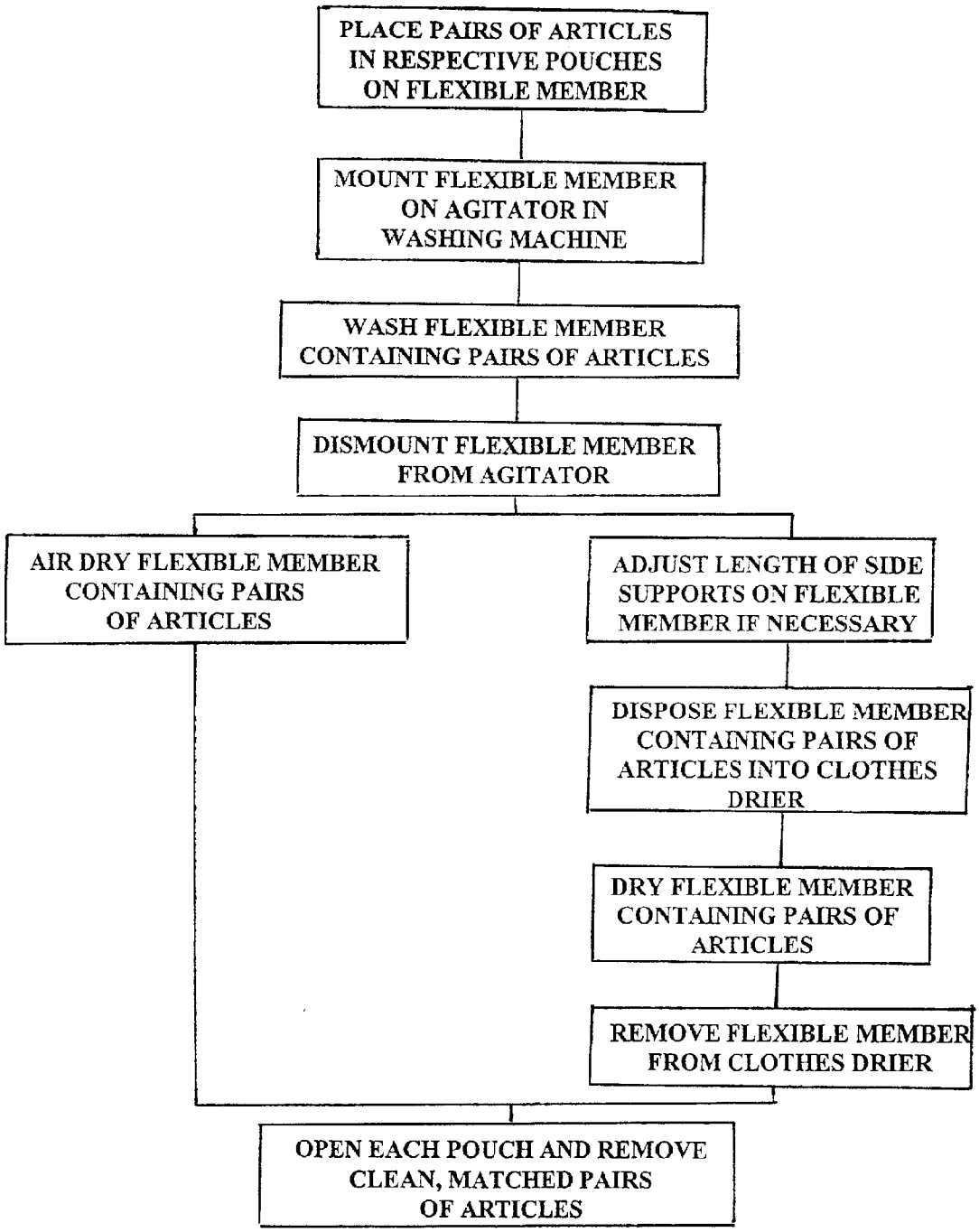
FIG. 12 is a sequence of the method of the present invention.

As shown in FIG. 11, each pouch 12 is opened separately and the clean articles or pairs of articles 13 are removed from each respective pouch 12. No further sorting or matching is required. No articles are lost and no delicate articles have been damaged. The method of using the present invention is summarized in FIG. 12. The only time that the soiled paired articles are handled is when these articles are placed in the pouches 12.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a washing machine having a rotating or oscillating agitator, a sock saver device comprising a substantially flexible member having first means thereon to mount the sock saver device on to the agitator for rotation or oscillation in unison, and second means externally on the sock saver device for carrying respective pairs of socks thereon and for maintaining the respective pairs of socks together during operation of the washing machine, such that the respective pairs of socks are always matched and are not separated or lost.

2. The combination of claim 1, wherein the first means is an opening in the flexible member wherein the agitator of the washing machine is received within the opening and the flexible member is disposed circumferentially around the agitator.

3. The combination of claim 2, wherein the opening is adjustable in cross sectional area such that the opening may be tightened around the agitator and secured thereto during rotation or oscillation of the agitator.

4. The combination of claim 1, wherein the flexible member is formed from a porous fabric through which water flows easily.

5. The combination of claim 4, wherein the fabric is a synthetic material.

6. The combination of claim 1, wherein the second means is a plurality of pouches into which respective pairs of socks may be received.

7. The combination of claim 6, wherein each pouch has a closure means thereon to retain the pair of socks within the pouch during a wash and dry cycle.

8. The combination of claim 1, wherein the flexible member may be partially collapsed axially to a reduced size.

9. The combination of claim 8, further comprising at least two collapsible side supports attached to the flexible member whereby the flexible member may be partially collapsed.

10. A method for keeping pairs of articles separated during washing in a washing machine, comprising the steps of:

providing a flexible member having a plurality of pouches formed externally thereon, the flexible member having means thereon to mount the flexible member on an agitator in the washing machine for rotation or oscillation in unison with the agitator, a plurality of matching pairs of articles to be washed, inserting each pair of articles in a separate pouch in the flexible member and closing all of the pouches, mounting the flexible member on the agitator, washing the flexible member containing the plurality of pairs of articles in the washing machine, and dismounting the flexible member from the agitator, drying the flexible member and the plurality of pairs of articles contained in the pouches, opening each pouch and removing the clean pairs of matched articles from each pouch wherein the pairs of matched articles are washed and dried and separated from all other pairs of articles.

11. The method of claim 10, further comprising the steps of:

providing a clothes drier, removing the washed flexible member containing the pairs of articles from the washing machine, disposing the washed flexible member containing the articles into the clothes drier, drying the flexible member and the articles in the pouches, removing the flexible member and the articles in the pouch from the clothes drier, and opening each pouch and removing cleaned pair of matched articles from each pouch.

12. The method of claim 11, wherein the flexible member has means thereon for shortening the flexible member, the method comprising shortening the flexible member to a selected length prior to disposing the flexible member containing the articles into the clothes drier.

13. A laundry container for holding matched articles of clothing during washing and drying comprising:

a substantially flexible member having a mounting means thereon, a plurality of pouches carried on the flexible member in which the matched articles of clothing are contained during the washing and drying, wherein the matched articles of clothing are always matched and are not separated or lost.

14. The laundry container of claim 13, wherein the flexible member has an open end having means thereon to adjust a size of the opening.

15. The laundry container of claim 13, wherein the means to adjust the size is a threaded means.

16. The laundry container of claim 13, wherein the means to adjust the size is a clamping means.

17. The laundry container of claim 13, wherein the means to adjust the size is tying means.

18. The laundry container of claim 13, wherein the flexible member may be partially collapsed axially to a reduced length.

* * * * *